US007055538B2

(12) United States Patent
Deng

(10) Patent No.: US 7,055,538 B2
(45) Date of Patent: Jun. 6, 2006

(54) FOLDABLE TENT HAVING EAVES

(76) Inventor: Jianrong Deng, Bihuge Xingcheng Shaminan Huangql Dist., Nanbai City, Guangdong Prov., 520240 (CN)

( * ) Notice: Subject to any disclaimer, the term of this patent is extended or adjusted under 35 U.S.C. 154(b) by 107 days.

(21) Appl. No.: 10/633,458

(22) Filed: Aug. 4, 2003

(65) Prior Publication Data

US 2004/0020527 A1 Feb. 5, 2004

Related U.S. Application Data

(63) Continuation of application No. PCT/CN02/00114, filed on Feb. 26, 2002.

(51) Int. Cl.
*E04H 15/50* (2006.01)

(52) U.S. Cl. ..... 135/131; 135/145; 135/117

(58) Field of Classification Search ..... 135/131, 135/145, 117
See application file for complete search history.

(56) References Cited

U.S. PATENT DOCUMENTS 1,846,011 A * 2/1932 Adams ..... 135/158
5,035,253 A * 7/1991 Bortles ..... 135/119
5,752,537 A * 5/1998 Kranzler ..... 135/128
6,283,136 B1 * 9/2001 Chen ..... 135/144
6,718,995 B1 * 4/2004 Dotterweich ..... 135/131
2004/0050412 A1 * 3/2004 Dotterweich ..... 135/131

* cited by examiner

*Primary Examiner*—Robert Canfield
(74) *Attorney, Agent, or Firm*—Charles I. Brodsky

(57) ABSTRACT

The foldable tent having eaves at the top of the sides of the Foldable frame [2] foldable eave frames [3] that extend outwardly can be folded together along with the frame [2] are provided. The covering 1 is put on the frame [2] having eave frames [3] which are n-shaped frames composed of a front side and two lateral sides. The front side is composed of a plurality of scissors frames [4] and the number of which is same to that of the cross beam [8] of the corresponding side of the frame [2] between two poles. Each of the lateral side is composed of a scissors frame [4]0 which is composed of two cross pieces pivotally connected to each other in the midway. All members of the framework [2] including the eave frames [3] are connected with each other through slide connection or pivot connection so that the tent can be used simply by extending the framework [2] and covering it with an tent covering [1].

6 Claims, 8 Drawing Sheets

FOLDABLE TENT HAVING EAVES

This is a Continuation of Application No. PCT/CN02/00114, filed Feb. 26, 2002.

FIELD OF THE INVENTION

The present invention relates to a tent for travelling or camping activities, and more particularly to a foldable tent having eaves.

BACKGROUND OF THE INVENTION

People often need to carry a canopy with them to shelter from strong sunlight, rain and wind when they go out on tours for pleasure. I have applied for Chinese patents App. No. 01215188.2 and App. No. 01215189.0. These two inventions disclosed a foldable tent without eaves and the tent covering only covers the area enclosed by the supporting members of the tent, providing a relatively small usable floor space.

It is obvious that said existing canopies have drawbacks that leave room for improvement.

BRIEF SUMMARY OF THE INVENTION

It is an object of this invention to overcome drawbacks of existing canopies and provide a foldable tent having eaves, which can provide a larger sheltering space by putting on a larger covering on the framework because of the eaves. The tent can be stricken simply by removing the covering and folding the framework, which is convenient to carry, transport and store.

The object of the present invention can be achieved by the following technical solutions. The present invention provides a foldable tent having eaves which includes a covering and a foldable framework. On top of the outer sides of the foldable framework, foldable eave frames that can be folded along with the foldable framework extending outwards are provided. A covering is put on the framework having eaves.

The object of the present invention can be further achieved by the following technical solutions.

Said foldable tent having eaves wherein the eave frame is an n-shaped frame composed of a front side and two lateral sides. The front side is composed of foldable scissors frames and the number of which is same to that of the cross beam of the corresponding side of the frame between two poles. Each of the lateral side is composed of a scissors frame composed of two cross pieces pivotally connected to each other in the midway. The scissors frames forming the front side of the n-shaped eave frame are pivotally connected to each other at the two ends of each scissors frames. The two opposite ends of each scissors frame are pivotally connected to the two corresponding outer ends of the scissors frame on the lateral sides to form flexion points. The inner ends of the scissors frames of the lateral sides are respectively connected to the upper pivot and lower pivot on a pole.

Said foldable tent having eaves wherein the eave frame is an n-shaped frame composed of a front side and two lateral sides. The front side is composed of foldable scissors frames and the number of which is same to that of the cross beam of the corresponding side of the frame between two poles. The two lateral sides of the eave frame are composed of two vertically arranged scissors frames. Each of the scissors frames is composed of two cross pieces pivotally connected to each other in the midway. The scissors frames forming the front side of the n-shaped eave frame are pivotally connected to each other at the two ends of each scissors frames. Two ends of the upper scissors frame forming the lateral side are pivotally connected to the two corresponding ends of the lower scissors frame on the same side. The outer ends of the upper scissors frame and the lower scissors frame of the lateral sides are pivotally connected to the two corresponding ends of the scissors frame on the front side to form flexion points. The inner ends of the scissors frame of the lateral sides are pivotally connected to the upper pivot and lower pivot on pole respectively.

Said collapsible canopy, wherein each of the four right angled branches of said cross hinge is provided with a hinge hole.

Said collapsible canopy, wherein said support members are made of hollow tubes, and when the framework is extended, the protruding end of a spring provided in the hollow support member where a hinge is provided passes through the wall of the hollow support member and is received by the hole on the downside hinge.

Said collapsible canopy, wherein the lower end of each support member is provided with a telescopic tube to raise the height of the canopy.

Said collapsible canopy, wherein cantilever support can be of various sizes according to different shapes of the roof structure of the collapsible canopy.

Detailed description of present invention with reference to exemplary embodiments and drawings is given hereunder.

DIAGRAM REMARKS

1—Covering
2—Frame
3—Eave frame
4—Scissors frame
5—T-shaped pivot
6—Upper pivot
7—Lower pivot
8—Cross beam
9—Tie rod
10—Pole
41—Joint

DETAILED DESCRIPTION OF THE INVENTION

Please refer to FIG. 1, FIG. 2, FIG. 3 and FIG. 4, which illustrate the first embodiment of the present invention. The foldable tent having eaves comprises a covering 1 and a foldable frame 2. A foldable eave frame 3 extending outwardly is provided at the top of the side of the foldable frame 2. The foldable eave frame 3 can be folded together with the frame 2. The covering 1 is put on the frame 2.

Figure 1:
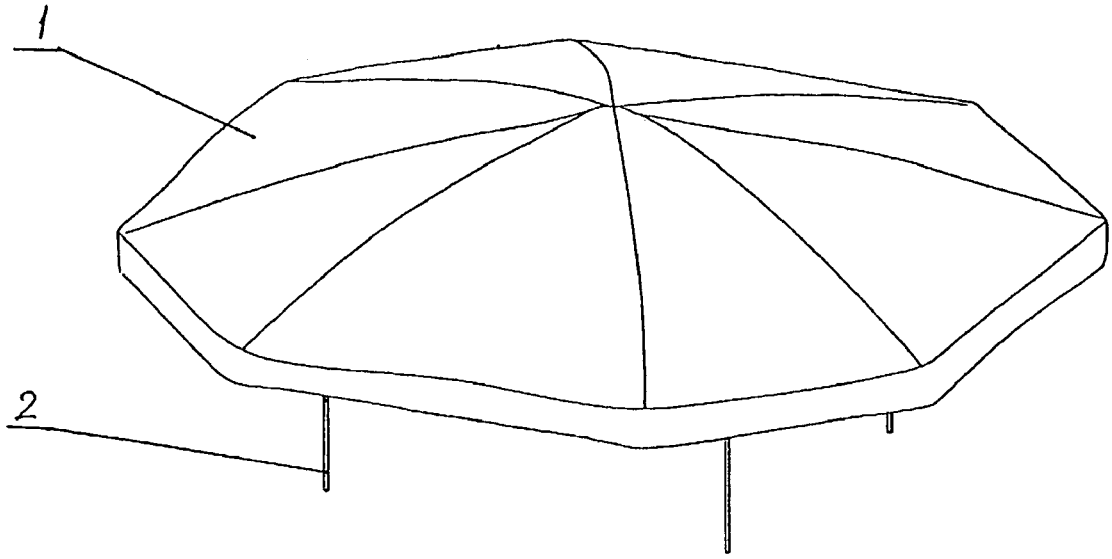
FIG. 1 illustrates a foldable tent having eave structure in a pitched configuration according to the first embodiment of the present invention.
Figure 2:
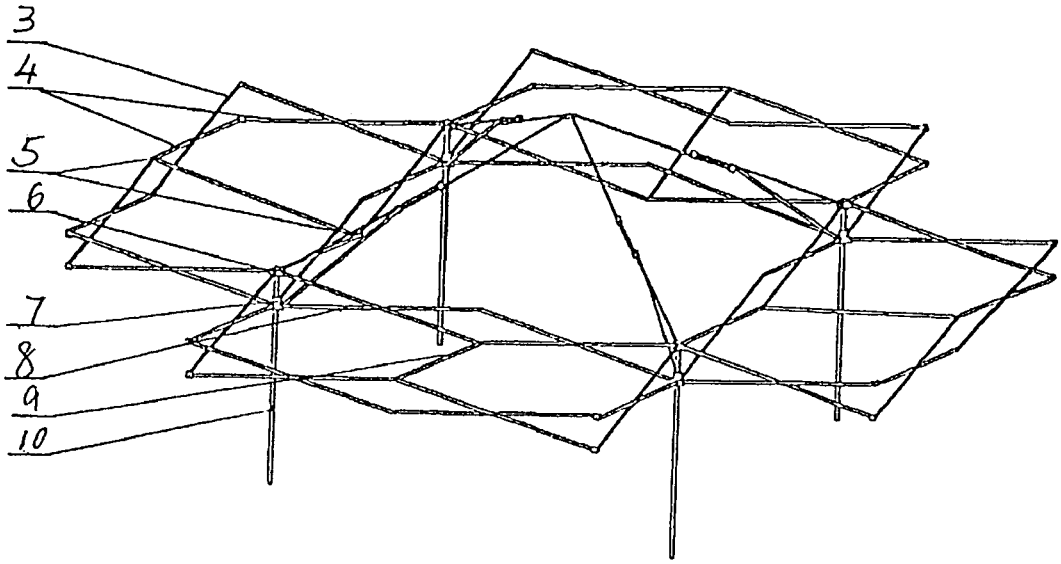
FIG. 2 illustrates a perspective view of a tent framework structure in a pitched configuration according to the first embodiment of the present invention.

Please refer to FIG. 2, the eave frame 3 is an n-shaped frames composed of a front side and two lateral sides. The front side is composed of foldable scissors frames 4 and the number of which is same to that of the cross beam 8 of the corresponding side of the frame 2 between two poles. Each of the lateral side is composed of a scissors frames 4 which is composed of two cross pieces pivotally connected to each other in the midway. The scissors frames 4 forming the front side of the n-shaped eave frame 3 are pivotally connected to each other at the two ends of each scissors frames 4. The two opposite ends of each scissors frame 4 are pivotally connected to the two corresponding outer ends of the scissors frame 4 on the lateral sides to form flexion points. The inner ends of the scissors frames 4 of the lateral sides are respectively connected to the upper pivot 6 and lower pivot 7 on pole 10.

Figure 3:
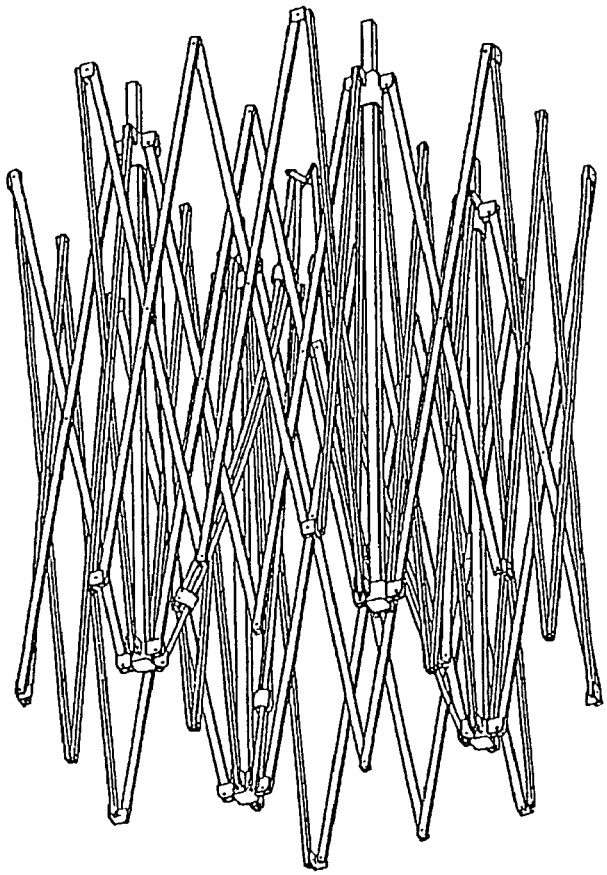
FIG. 3 illustrates a tent framework in a folded configuration according to the first embodiment the present invention.

Please refer to FIG. 3, when not in use, the foldable tent having eaves of the present invention can be stricken by removing the covering 1 and folding the frame 2 and eave frames 3.

Please refer to FIG. 5, FIG. 6, FIG. 7, FIG. 8, and FIG. 9, which illustrate the second embodiment of the present invention. The eave frame 3 is an n-shaped frames composed of a front side and two lateral sides. The front side is composed of foldable scissors frames 4 and the number of which is same to that of the cross beam 8 of the corresponding side of the frame 2 between two poles. The two lateral sides of the eave frame 3 are composed of two vertically arranged scissors frames 4. Each of the scissors frames 4 is composed of two cross pieces pivotally connected to each other in the midway. The scissors frames 4 forming the front side of the n-shaped eave frame 3 are pivotally connected to each other at the two ends of each scissors frames 4. Two ends of the upper scissors frame 4 forming the lateral side are pivotally connected to the two corresponding ends of the lower scissors frame on the same side. The outer ends of the upper scissors frame and the lower scissors frame of the lateral sides are pivotally connected to the two corresponding ends of the scissors frame 4 on the front side to form flexion points. The inner ends of the scissors frame 4 of the lateral sides are pivotally connected to the upper pivot 6 and lower pivot 7 on pole 10 respectively. The construction of other parts of this embodiment of the tent structure is same to that of the first embodiment of the present invention.

Figure 4:
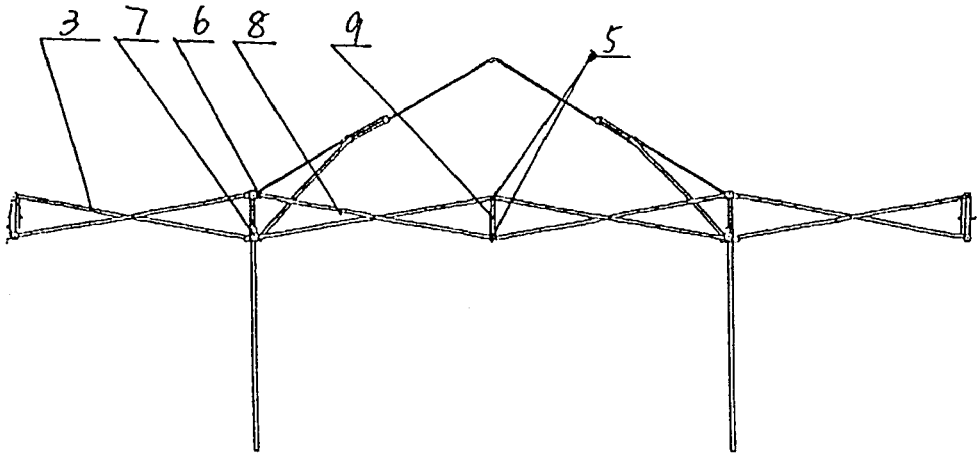
FIG. 4 illustrates a tent framework structure configuration according to the first embodiment of the present invention.
Figure 5:
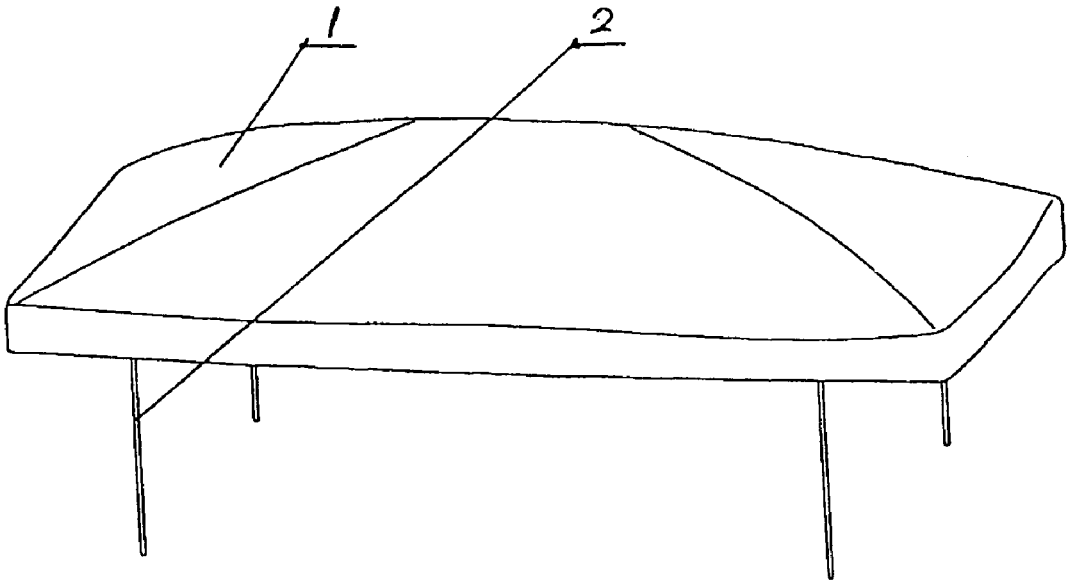
FIG. 5 illustrates a foldable tent having eave structure in a pitched configuration according to the second embodiment of the present invention.
Figure 6:
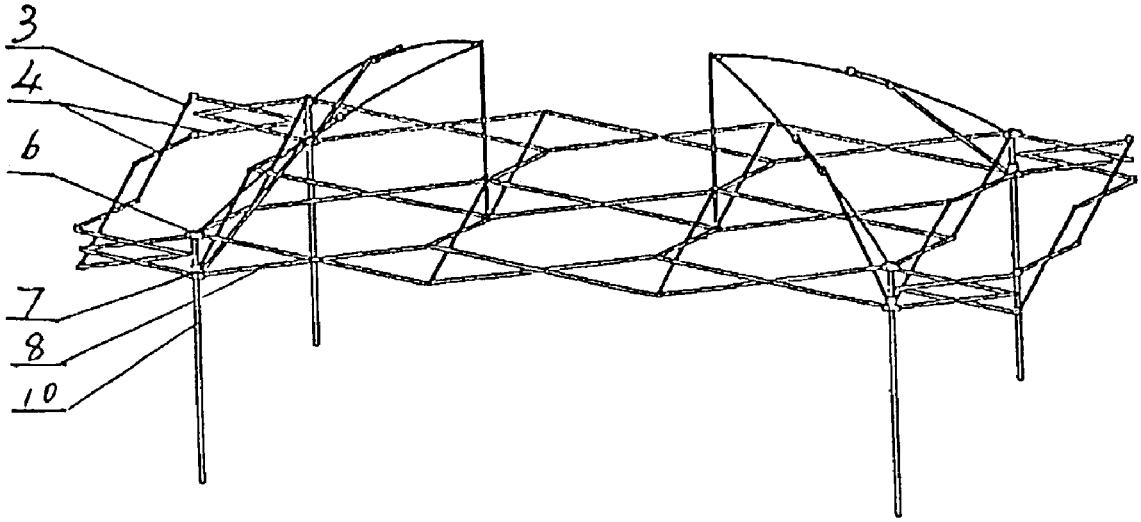
FIG. 6 illustrates a perspective view of a tent framework structure in a pitched configuration according to the second embodiment of the present invention.

Please refer to FIG. 4, the first embodiment of the present invention can also include a T-shaped pivot 5 provided at the upper connection point of the scissors frames 4 of the front side to connect a tie rod 9. The other end of the tie rod 9 is pivotally connected to the another T-shaped pivot 5 provided at the lower connection point of the scissors frames 4 at the corresponding side of the framework between two poles. The construction of other parts of this embodiment of the tent structure is same to that of the first or second embodiment of the present invention.

Figure 10:
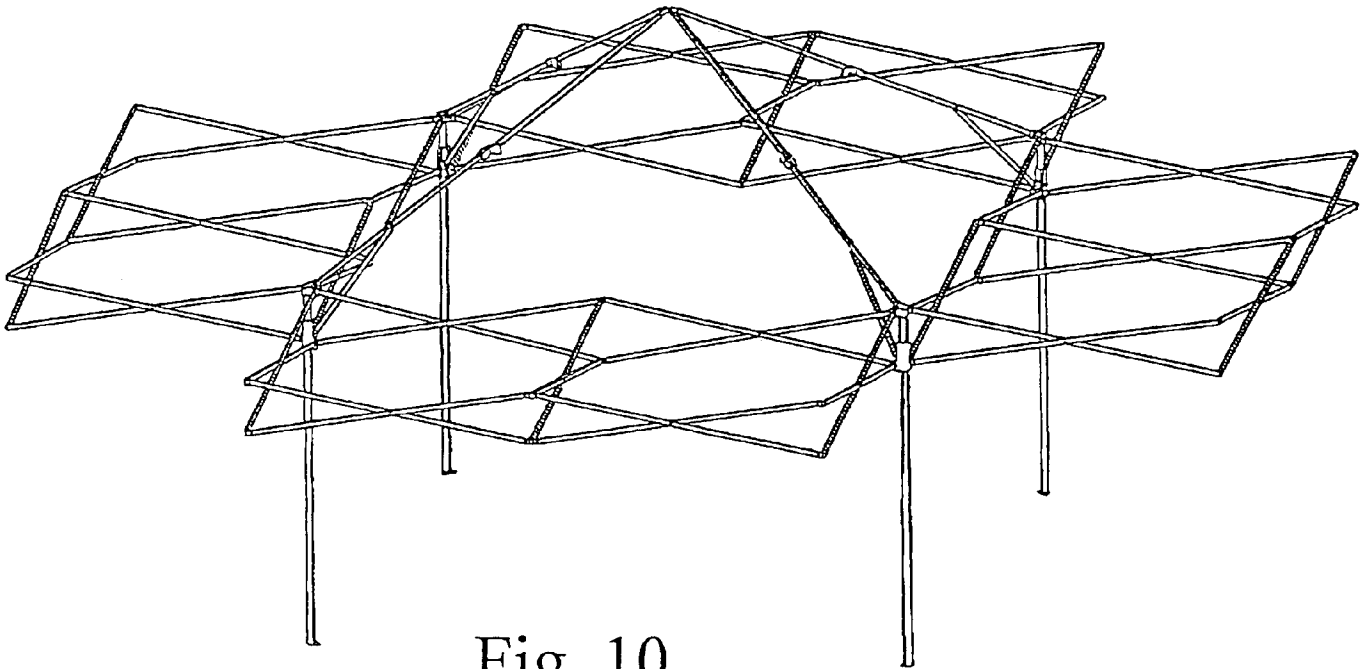
FIG. 10 illustrates a perspective view of a tent framework structure according to the third embodiment of the present invention.
Figure 11:
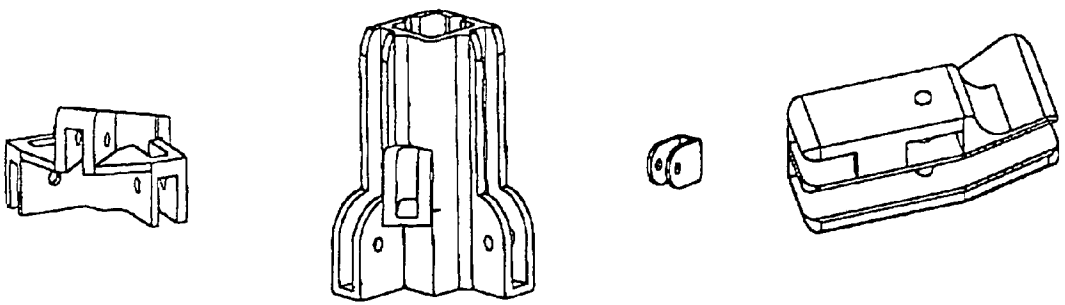
FIG. 11 illustrates a perspective view of a joint of the tent framework structure according to the third embodiment of the present invention.
Figure 12:
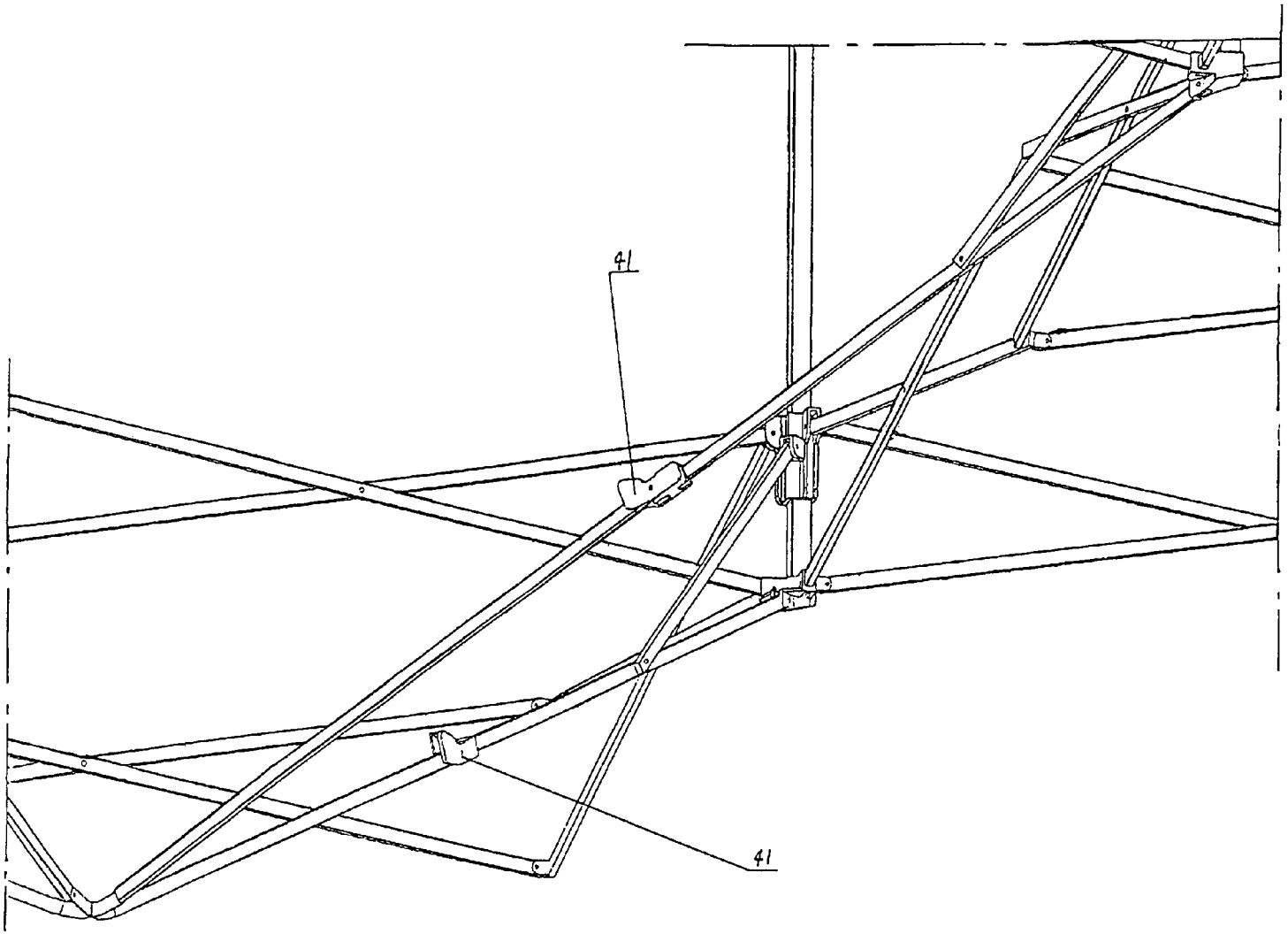
FIG. 12 illustrates a partially enlarged framework of FIG. 10.
Figure 13:
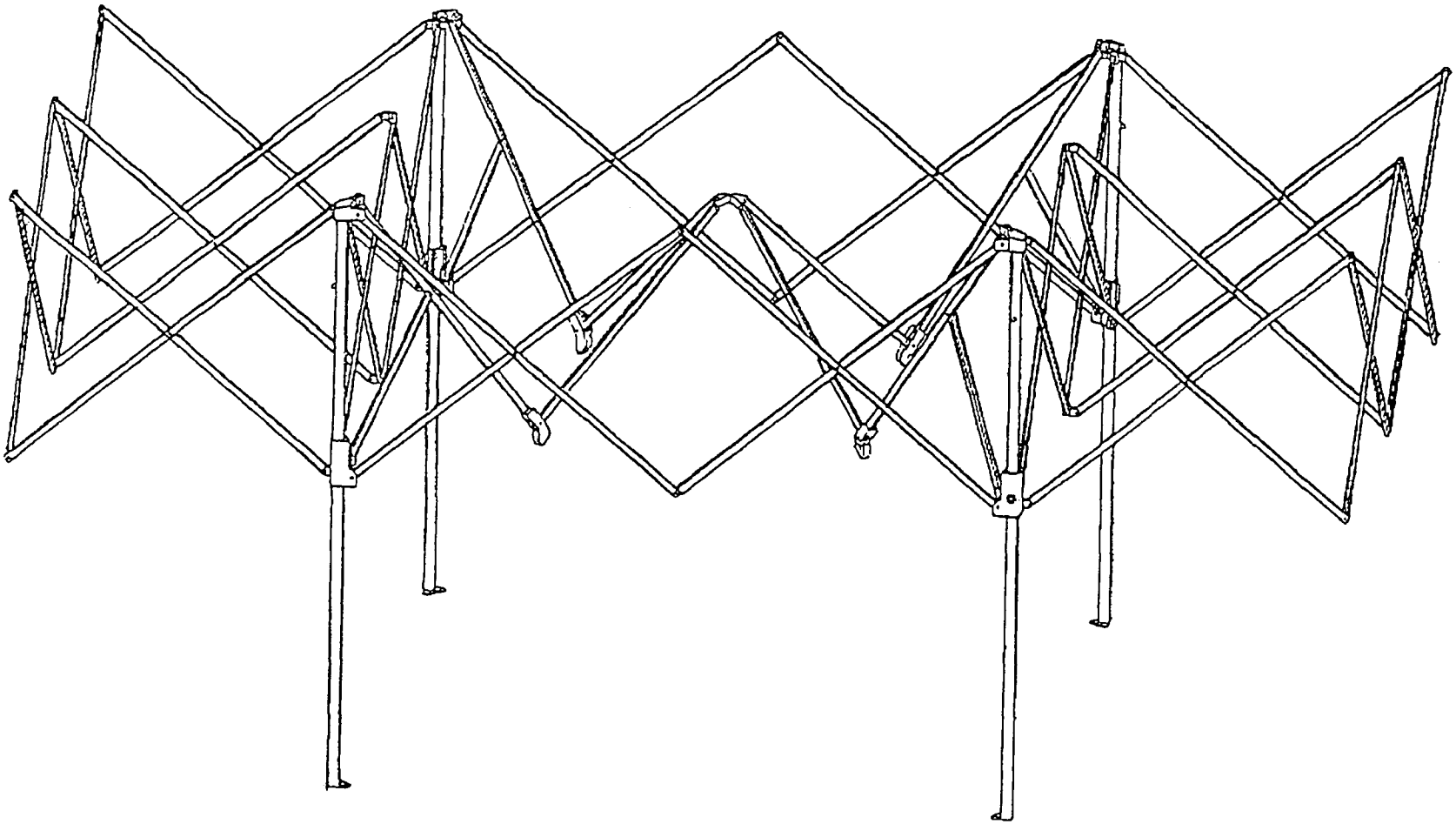
FIG. 13 illustrates a perspective view of a tent framework structure in folding process according to the third embodiment of the present invention.

Please refer to FIG. 10, FIG. 11, and FIG. 12, which illustrate the third embodiment of the present invention. The scissors frames 4 are connected through joint 41 so as to avoid overlapping of the two ends of scissors frames 4 to reduce the occupying volume when they are folded. The construction of the joint 41 is illustrated in FIG. 11. Both ends of the joint 41 have clefts which are not on the same plane. When the framework 2 is folded, as illustrated in FIG. 13, the two ends of the scissors frames 4 form a V-shaped structure without overlapping each other. The construction of other parts of this embodiment of the tent structure is same to that of the first or second embodiment of the present invention.

In the first, the second and the third embodiment of the present invention, the eave frames 3 can choose to be provided either at all sides, or at two opposite, or only at one side of the framework with a covering 1 that matches the framework 2 having eaves put on framework 2.

Figure 7:
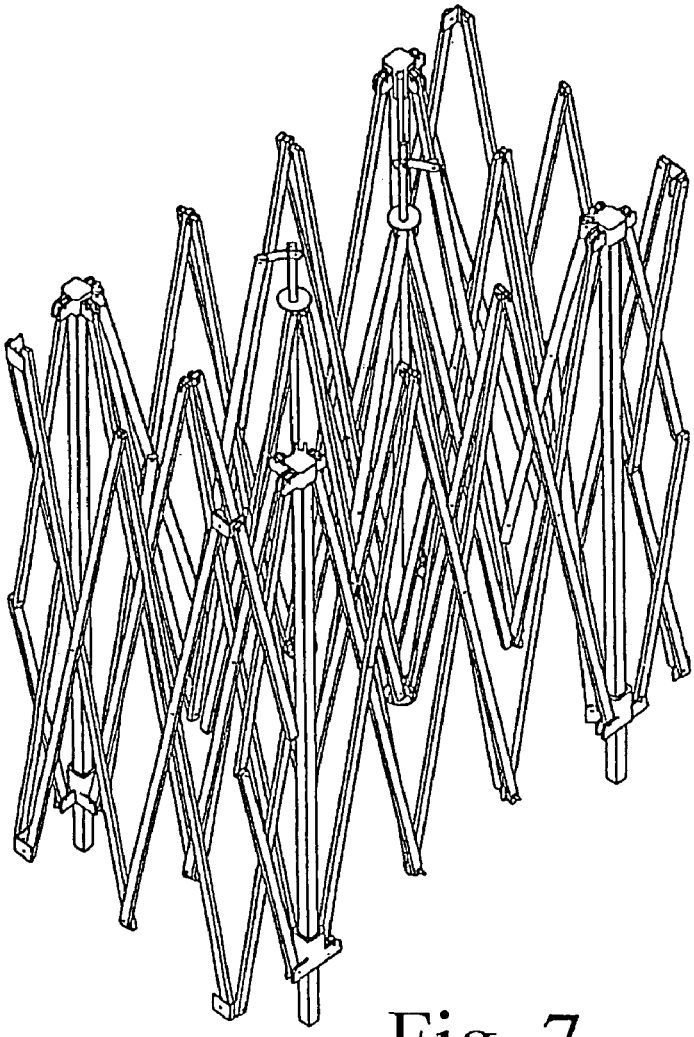
FIG. 7 illustrates a tent framework in a folded configuration according to the second embodiment the present invention.
Figure 8:
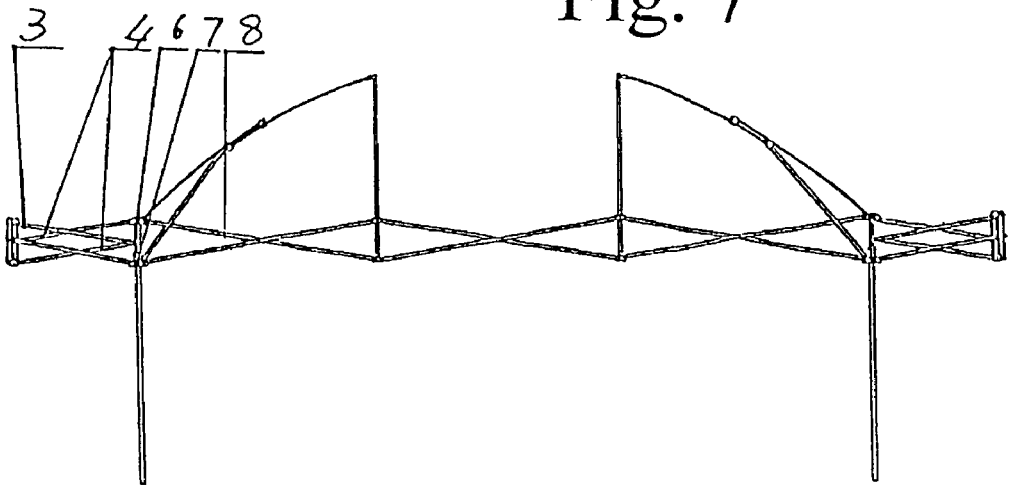
FIG. 8 illustrates a tent framework structure according to the second embodiment of the present invention.
Figure 9:
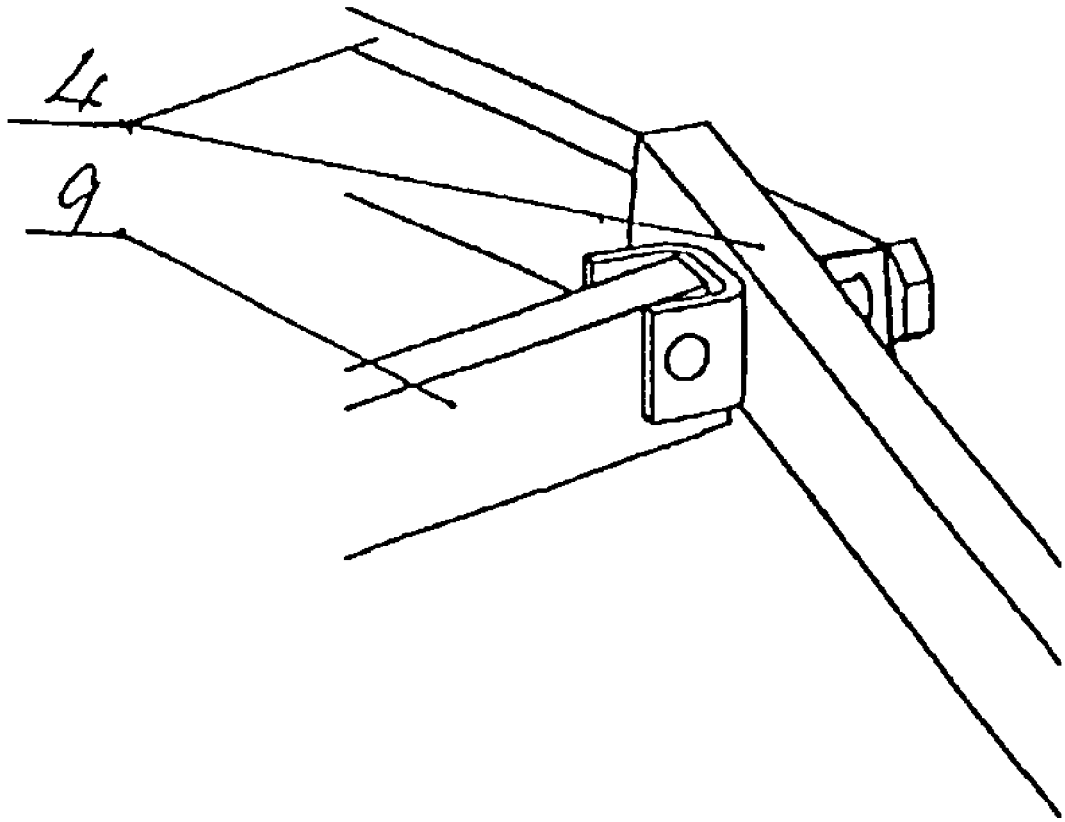
FIG. 9 illustrates a T-shaped hinge according to the second embodiment of the present invention.

Please refer to FIG. 7, the foldable tent having eaves can be stricken simply by removing the covering 1 and folding the framework 2 when the tent is not in use.

It is obvious that the present invention has advantages over the prior art. From the technical method described above one can know that a foldable tent having eaves includes eave frames extending out and a matching covering. All the connections between the foldable frames and members are of sliding type or pivot type so that it can be pitched simply by unfold the frame work and put on a covering or stricken simply by removing the covering and folding the framework, making it easy to carry with and transport. The present invention can extend the area for shielding from strong sunlight or rains.

Accordingly, the above described are only the preferred embodiments of the present invention which does not in any way limit the present invention. It should be appreciated that any modifications or changes may be made according to the preferred embodiments of the present invention without departing from the scope of technical solutions described herein.

What is claimed is:

1. A foldable tent having eaves that is characterized in that a covering [1] and a foldable frame [2] and at the top of the side of which a foldable eave frame [3] extending outwardly is provided, foldable eave frame [3] is folded together with frame [21] and the covering [1] is put on the frame [2].

2. A foldable tent having eaves according to claim 1 that is characterized in that said eave frame [3] is an n-shaped frame composed of a front side and two lateral sides, the front side is composed of foldable scissors frames [4] and the number of which is same to that of the cross beam [8] of the corresponding side of the frame [2] between two poles, each of the lateral side is composed of a scissors frames [4] which is composed of two cross pieces pivotally connected to each other in the midway, the scissors frames [4] forming the front side of the n-shaped eave frame [3] are pivotally connected to each other at the two ends of each scissors frames [4], the two opposite ends of each scissors frame [4] are pivotally connected to the two corresponding outer ends of the scissors frame [4] on the lateral sides to form flexion points, the inner ends of the scissors frames [4] of the lateral sides are respectively connected to the upper pivot [6] and lower pivot [7] on pole [10].

3. A foldable tent having eaves according to claim 1 or claim 2 that is characterized in that said eave frame [3] is an n-shaped frames composed of a front side and two lateral sides, and the front side is composed of foldable scissors frames [4] and the number of which is same to that of the cross beam [8] of the corresponding side of the frame [2] between two poles, the two lateral sides of the eave frame [3] are composed of two vertically arranged scissors frames [4], each of the scissors frames [4] is composed of two cross pieces pivotally connected to each other in the midway, the scissors frames [4] forming the front side of the n-shaped eave frame [3] are pivotally connected to each other at the two ends of each scissors frames [4], two ends of the upper scissors frame [4] forming the lateral side are pivotally connected to the two corresponding ends of the lower scissors frame on the same side, the outer ends of the upper scissors frame and the lower scissors frame of the lateral sides are pivotally connected to the two corresponding ends of the scissors frame [4] on the front side to form flexion points, the inner ends of the scissors frame [4] of the lateral sides are pivotally connected to the upper pivot [6] and lower pivot [7] on pole [10] respectively.

4. A foldable tent having eaves according to claim 2 or claim 3 that is characterized in that a T-shaped pivot [5] is provided at the upper connection point of the scissors frames [4] of the front side to connect a tie rod [9], the other end of the tie rod [9] is pivotally connected to the another T-shaped pivot [5] provided at the lower connection point of the scissors frames [4] of the cross beam [8] of the corresponding side of the framework between two poles.

5. A foldable tent having eaves according to claim 4 that is characterized in that said eave frames [3] can choose to be provided either at all sides, or at two opposite, or only at one side of the framework [2] with a covering [1] that matches the framework [2] having eaves put on framework [2]

6. A foldable tent having eaves according to claim 2 or claim 3 that is characterized in that one end of said scissors frame [4] is connected to one end of the another scissors frame [4] through a joint [41].

* * * * *